United States Patent [19]

Grover

[11] Patent Number: 4,613,991

[45] Date of Patent: Sep. 30, 1986

[54] WORK PANTS

[76] Inventor: Scott T. Grover, 621 - 11th St., Bemidji, Minn. 56601

[21] Appl. No.: 810,561

[22] Filed: Dec. 19, 1985

[51] Int. Cl.[4] ..... A41D 13/06; A41D 27/20

[52] U.S. Cl. ..... 2/23; 2/227; 2/247; 2/250

[58] Field of Search ..... 2/23, 22, 24, 79, 227, 2/247, 250

[56] References Cited

U.S. PATENT DOCUMENTS

| | | | |
|---|---|---|---|
| 478,190 | 7/1892 | Hamilton et al. | 2/227 |
| 478,281 | 7/1892 | Hamilton et al. | 2/227 |
| 562,608 | 6/1896 | Herbelin . | |
| 683,029 | 9/1901 | Estes . | |
| 871,760 | 11/1907 | Long . | |
| 1,304,613 | 5/1919 | Smedley | 2/227 |
| 2,501,111 | 3/1950 | Walker . | |
| 2,568,083 | 9/1951 | Mitchell . | |
| 3,046,563 | 7/1962 | Coleman . | |
| 3,440,666 | 4/1969 | Fitzpatrick . | |
| 3,782,614 | 1/1974 | Campisi . | |
| 4,561,124 | 12/1985 | Thompson | 2/23 |

FOREIGN PATENT DOCUMENTS

| | | | |
|---|---|---|---|
| 971703 | 7/1975 | Canada | 2/23 |

*Primary Examiner*—H. Hampton Hunter
*Attorney, Agent, or Firm*—Robert C. Baker

[57] ABSTRACT

A pair of fabric work pants particularly designed for kneeling work activity has removable leather patches covering the knee area and a depending portion of each pant leg. Containment spaces are formed between the patches and the underlying fabric for holding padding material for protection of the user's knees. Leather utility pockets are also shown for the pants. The leather patches and the utility pockets are releasably attached to the work pants to facilitate laundering of the underlying fabric garment without damaging the leather. A further comfort feature of the pants comprises a fabric insert in the nature of a crotch gusset.

9 Claims, 3 Drawing Figures

Fig. 1.
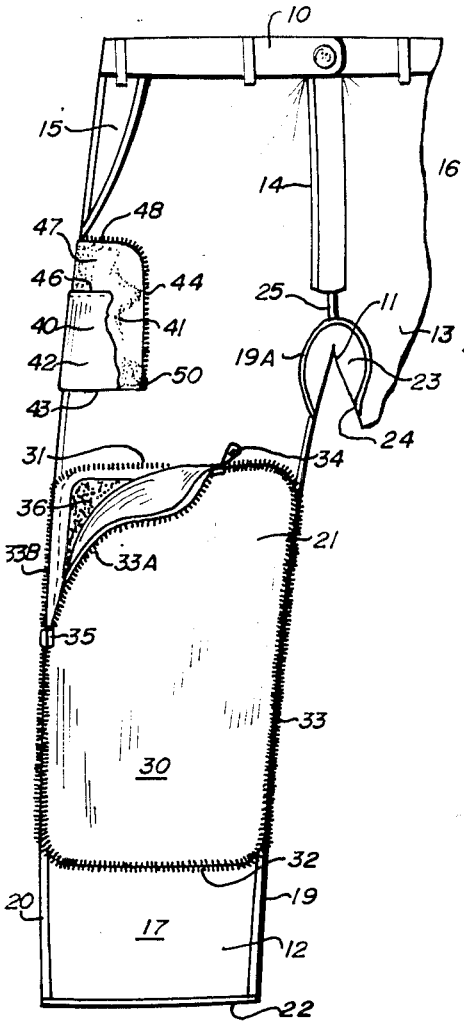
Fig. 2.
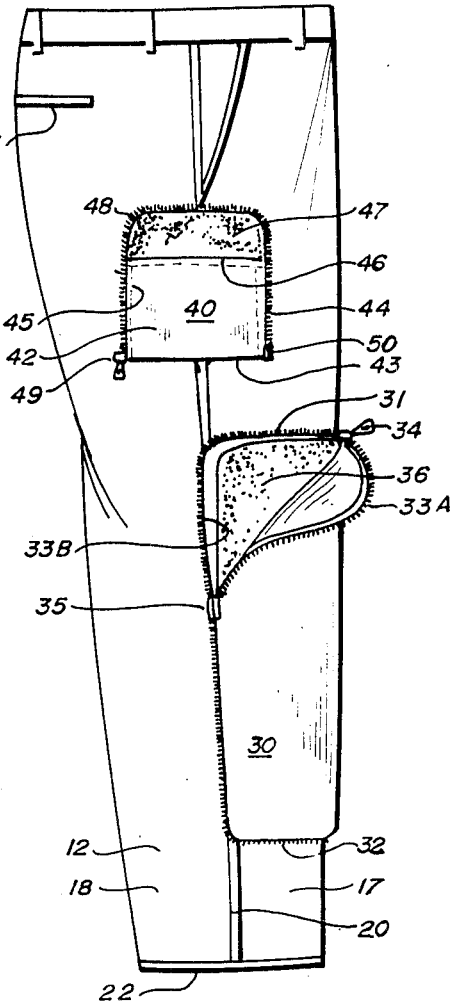
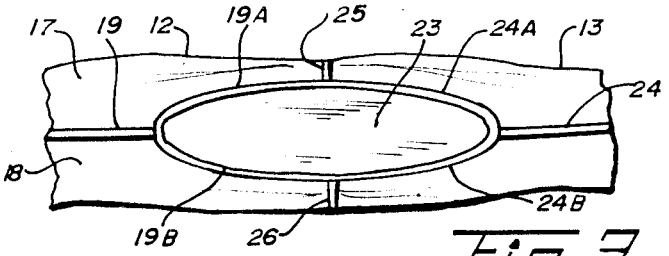
Fig. 3.

WORK PANTS

BACKGROUND OF THE INVENTION

The present invention relates generally to work pants and in particular to work pants designed for kneeling work activity. The pants incorporate removable knee and leg protection means, and preferably also incorporate releasably attached pockets as well as a crotch gusset.

Various work activities require a great deal of time spent in a kneeling position wherein the worker's knee and shin are often in contact with the floor or with work tools. In particular, the job of carpet laying requires, in addition to a substantial amount of kneeling, the use of the knee or lower thigh to push against various carpet stretching tools involved in the process of carpet installation. Various strap-attached knee pads have been proposed for knee protection. However, such straps tend to constrict the knee area, causing discomfort. They also allow the knee pad itself to become dislodged from its proper position, thus requiring frequent readjustment. Furthermore, it is desirable that padded protection extend more than just at the knee area as the thigh and portions of the shin are often in contact with, or hitting, working tools during the kneeling work activity of carpet installation.

Another approach to knee area protection is seen in fabric pants that incorporate permanent knee pads into their construction. However, permanently attached knee pads require a compromise between ease of laundering and pad size or thickness. If the pad is very thick, or has a large surface area, it can during washing become so saturated and weighty with water that it presents washload weight and balance problems, and can be very difficult to dry. Thus, to permit easy washing, a permanent knee pad normally will cover only the knee area and not be of sufficient thickness or area of coverage for adequate protection in work activities such as carpet laying. Furthermore, it is extremely comfortable to pull up or raise one's pant legs prior to kneeling so as to provide extra material at the crotch and knee area for comfort and to avoid binding constrictions of material in those areas. However, if only a small knee area on each pant leg area is padded, the above-stated procedure of readjusting each pant leg for comfort in kneeling can result in the fixed padded knee portion being pulled up and over the knee, and thus not available for protecting the knee.

Other factors of general importance for work clothing are its durability and ease of cleaning. All cloth or fabric articles eventually wear out due to breakage of individual fibers as a result of use, but washing to remove soil enhances the wear life of such clothing. Of course, vulnerable wear areas of clothing may be protected by patches of leather to enhance durability. Leather patches such as those of cow or horse hide are very durable, but their use in clothing, particularly fabric work clothing requiring washing, is very limited because leather is damaged by conventional laundering, and other cleaning techniques for work clothing are too expensive for practical use.

An important function of work pants is to provide some means (such as loops or pockets) for carrying various work implements or tools. Such carrying means are most often made from the same material as the work pants, typically a heavy cotton denim material, and are subject to the problem of premature wear and breakage due to the repeated insertion and removal of tools from them.

Insofar as is known, no one has heretofore provided work pants designed for high comfort of the user in kneeling work activity, adjustable for comfort and yet fully effective and extensively padded for the protection of the user's knees and associated areas, and also possessing the wear durability of leather for the knee and associated areas as well as for tool pockets, while at the same time preserving ease of repeated low cost cleaning by conventional laundering.

SUMMARY OF THE INVENTION

The invention consists of a pair of pants especially constructed for work that requires kneeling. The invention solves the problem of premature wear of the knee and lower leg area. In its preferred form, the invention also solves the problem of premature wear of tool carrying pocket means. The invention employs leather or equivalent while at the same time permitting conventional laundering.

The work pants include removable leg patches that cover a larger portion of the leg than conventional knee pads. The leg patches consist of leather and are releasably attached to the fabric of each pant leg by a slide fastener such as a zipper. In this manner the excellent wear resistent characteristics of leather are achieved without sacrifice of conventional laundering since the patches are removable prior to washing the underlying garment. In addition, a large padding containment space is created between the leather patch and the fabric of the underlying garment into which space various padding materials of layered form can be added for cushioning and protecting a user's knee as well as associated areas such as portions of the user's shin. The padding is removable from the space, thus the amount of the padding does not have to be compromised due to washing considerations and can therefore be of sufficient thickness to fully cushion and protect a user's knee even for drop kneeling activity (i.e., quick "falling" to one's knees as in carpet installation work). The preferred form of releasable attachment of the leather patches consists of a slide fastener around the entire perimeter of the pathc, thereby permitting secure holding of the padding material through total enclosure of it. The leg patches of the present invention cover an area on the front of each pant leg starting above the knee level area of the pant leg and extending downwardly to a level at least two-thirds of the distance toward the ankle end of the pant leg. The size of the patches provides a sufficiently large padding containment space so that a user's knees will always be protected even when the pant legs are pulled up or raised in a conventional way to enhance crotch and knee area comfort during kneeling.

The pants preferably also include removably attached leather utility pockets for holding various work articles or tools. The utility pockets are on the mid outer thigh area of each pant leg at a location approximately midway between the knee and the waistband line of the pants. The utility pockets are preferably attached to the pants by slide fasteners and are removable prior to washing the underlying garment fabric of the pants. Importantly, the attachment is designed to support the pockets firmly but allow for some shift of the underlying fabric with respect to the pocket as a user moves in work activity and as the weight of tools in the pocket varies.

In the most preferred form, the work pants also include means providing increased room in the crotch area to further improve comfort for the kneeling and bending user.

Other features and advantages of the invention will become apparent as this description proceeds.

BRIEF DESCRIPTION OF THE DRAWING

FIG. 1 shows a partial front view of the new work pants, with the left leg member of the pants partially broken away and the patch for the right leg member partially unzipped.

FIG. 2 shows a side view of the new work pants, with the leg member patch partially unzipped.

FIG. 3 is a fragmentary view showing detail of the preferred crotch area.

DESCRIPTION OF THE PREFERRED EMBODIMENTS

A pair of work pants made according to the present invention has a basic fabric structure suitably formed or made out of heavyweight washable material, preferably a cotton denim. The fabric structure of the pants includes a waistband 10, a crotch area 11, a right leg member 12, a left leg member 13, the fly 14, a conventional hand pocket 15, and a conventional rear pocket 16. As customary for the basic design of pants, the conventional hand pocket 15 has a tapered or sloped access opening extending from outseam 20 of the pants right leg member to the waistband 10. It is emphasized that the left leg member 13 of the pants is essentially a mirror image of the construction of the right leg member; and only details of the right leg member will be recited. The right leg member is formed by a front panel 17 and a rear panel 18 (see FIGS. 1 and 2). These panels suitably extend from the waistband 10 to the ankle end 22 of the leg member. They are joined along their side edges at inseam 19 extending from the ankle end to the crotch area and an outseam 20 extending from the ankle end 22 upwardly to, in essence, the waistband 10. For convenience in describing the invention, the leg members are looked upon as normally being in vertical orientation and as having a knee level area 21 which can vary in its precise location between the crotch 11 and ankle end 22 but generally is approximately two-fifths of the distance from the crotch to the ankle end 22.

Referring to FIGS. 1 and 3, the preferred fabric portion of the pants structure includes a special crotch gusset 23 of fabric material. This gusset is inserted in the crotch area to provide increased room in that area or that portion of the pants. The gusset 23 is suitably approximately oval in shape; and is inserted so as to provide an extra expanse of material between the front and rear leg panels of each leg member at the crotch area. In essence, the inseam 19 for the right leg member and the inseam 24 for the left leg member 13 become bifurcated at the crotch area and continue as inseams 19A and 19B about the perimeter of the crotch gusset 23 for the right leg member, and continue for the left leg member as inseams 24A and 24B about the other half of the crotch insert 23. Seam 25 between the front panels of the leg members at a location just below the fly 14, as well as the central buttocks seam 26 between the rear panels of the leg members are essentially undisturbed by the insertion of the crotch gusset; and the lack of seams in the gusset structure 23 is an important feature contributing to comfort for the user during repetitive standing and kneeling work activities as commonly encountered in carpet laying.

Each pant leg member has a releasably attached leather patch over the front panel of the leg member, as illustrated by the leather patch 30 which lies over the front leg panel 17 of the right leg. Leather patch 30 covers an area extending laterally from the outseam 20 to the inseam 19 of leg member 12. Lengthwise, leather patch 30 covers an area on leg member 12 which extends from a level 31 above the knee level area 21 downwardly along the leg member 12 (over the front panel 17 of the leg member) to a level 32 located at least about two-thirds of the distance between the knee level area 21 and the ankle end 22 of the leg member. While leather patch 30 may start from a level just above the knee level area, it is preferable that leather patch 30 extend somewhat higher over the front panel 17 than a level merely just above the knee level area. On the other hand, the level 31 should be below the crotch area and no higher than approximately midway between the crotch area 11 and the knee level area 21. (The upper extremity of patch 30 desirably covers a portion of the thigh adjacent the knee level area 21 because the lower portion of the thigh is frequently used to apply pressure in carpet laying activity.)

Patch 30 is attached to leg member 12 by a slide fastener generally designated 33 but having separable halves 33A and 33B. The first half 33A is sewn to the entire perimeter of the patch 30, preferably along the inner edge of the perimeter (i.e., the edge facing the fabric of leg member 12). The other or second half 33B of the slide fastener is permanently fixed to the fabric of the leg member along the entire perimeter of the area of coverage of the patch 30 so as to provide a mating slide fastener relationship to the first half 33A fixed to the patch 30 itself. The slide fastener suitably consists of a zipper having two parts each formed of a chain of teeth on a cloth or fabric strip or ribbon. One of the parts or halves, preferably the half 33A fixed to the perimeter of the patch 30, is provided with a slide 34 including a handle for operation of the slide 34 plus an end connector 35. The end connector 35 as well as the slide 34 are permanently part of the half of the slide fastener 33A and thus removed from the fabric pants structure when the patch 30 is removed therefrom. The half 33B of the slide fastener is most preferably sewn to the fabric of the pant leg member along a line permitting the lateral portions of it to be incorporated in the inseam 19 and outseam 20 of the pant leg member. Thus the clotch edge ribbon of that half of the slide fastener is preferably sewn between the front and rear panels of the leg member along the inseam and outseam portions thereof. Specifically, the half 33B is sewn to the fabric of the pant leg member 12 along inseam 20 from a point starting at the end to which the separable end connector 35 is mated to it. It extends downwardly along inseam 20, then curves into a line across the front panel of the leg member 12 at level 32, and then curves again to merge into the portion of it sewn into the inseam 19. From the inseam 19 the zipper half 33B curves again and is sewn to the fabric of the front panel 17 of leg member 12 along the level line 31, and finally curves and is sewn into the outseam 20 to the point of termination of the zipper half 33B. That termination point is near or immediately adjacent the beginning point of it where end connector 35 is removably attached to it. Thus leather patch 30 is releasably attached to the leg member about the entire perimeter of the patch, but is conveniently removable in its entirety from leg member 12 so as to avoid laundering damage to the leather of the patch at times of washing the underlying fabric of the pants structure.

When patch 30 is attached to leg member 12 by zipper 33, a padding containment space is created between patch 30 and the fatric of pant leg 12 underlying patch 30. Padding 36 can be placed in this containment space. In the preferred form of the present invention, padding 36 is in layer form as distinct from padding of particulate or easily reshaped form. The layer form resists "bunching" or collapse. The cushion padding extends over the entire expanse or area covered by the leather path. It is coextensive with the area of the patch. The preferred layer form padding is flexible but has sufficient body to resist a wrinkling type collapse. Conventional carpet padding may be used. For example, two layers of 9/16th inch elastomeric or rubbery carpet padding give excellent results. Carpet itself may be used. It will be appreciated that complete removal of patch 30 can be effected; and similarly, complete removal of padding 36 can be effected prior to the laundering of the fabric of the work pants. Thus, padding 36 need not be laundered, or can be separately cleaned. Patch 30 and padding 36 therefore protect the fabric of pant leg member 12 underlying the same from wear that occurs during kneeling activities. The padding containment space with the padding therein, and the patch, serve to protect the worker's knee (including protection from jarring damage by drop kneeling) and associated areas during kneeling work activity. It will be appreciated that perimeter zipper 33 permits the total enclosure of padding material within the padding space for securely holding it therein.

Utility pocket 40 (FIGS. 1 and 2) is used to carry various work tools. It is centered on outseam 20 at a point therealong approximately midway between waistband 10 and knee level area 21, but above the upper level 31 of patch 30. Basically, utility pocket 40 is located on the worker's mid to upper outer thigh. Its upper extremity should be adjacent or near the lower end of the sloped access opening for hand pocket 15, and its lower extremity above patch 30. Utility pocket 40 suitably consists of a piece of leather that has been folded to form an outer pocket section 42 and an inner pocket section 41 (viewable in FIG. 1 at the broken-away part of outer section 42). The bottom 43 of pocket 40 is formed by the line of fold between inner pocket section 41 and outer pocket section 42. The bottom 43 is oriented towards ankle end 22. Pocket 40 has a forward vertical side 44 and rearward vertical side 45; each vertical side extends perpendicularly to the horizontal bottom line 43 and each vertical side is closed by sewing or riveting outer pocket section 42 to inner pocket section 41 along each vertical side. It can be appreciated that inner section 41 and outer section 42 could consist of two separate pieces of leather which would then require the closure of bottom 42 by stitching or rivets or the like therealong. However, a fold along bottom 43 is highly wear resistant and more damage resistent than a closure of stitching or the like, particularly where heavy tools are inserted and carried in the pocket. The utility pocket has a top opening 46 oriented toward waistband 10, and has a pocket access protection area 47, extending above pocket opening 46 and formed by an upward extension 47 of inner pocket section 41 above the top end of outer pocket section 42. Pocket access protection area 47 serves to protect the fabric of the work pants underlying it from the abrasive wear associated with insertion and removal of tools from the pocket. The utility pocket as a whole, that is, in its entirety, is releasably attached to leg member 12 by a pocket attachment slide fastener or zipper 48 formed of separable halves. One half of zipper 48 is sewn to the perimeter of inner pocket section 41, other than along bottom fold 43; and this half on the inner pocket section suitably carries the slide 49 and end connector 50 of the zipper. The other half of zipper 48 is sewn to the fabric of pant leg member 12 underlying pocket 40 for a mating relationship to the half on the inner pocket section. It can be seen that zipper 48 forms an inverted U-shape which permits easy unzipping, and thus, removal of leather pocket 40 from pant leg member 12 for laundering of the fabric of the pants without causing laundering damage to the leather of the pocket. Also, zipper 52 does not extend along the bottom line 43 of the pocket. The bottom 43 is unattached to pant leg member 12 and therefore free to move with respect thereto. Thus the weight of tools in the pocket does not cause bunching or sagging of fabric of the pants along the bottom fold 43. Further, movement of fabric of the pants relative to bottom fold 43 of the attached pocket during the work activity is possible during the work activity and contributes to comfort of the wearer.

It is contemplated that one strategy for practicing the present invention involves modifying a pair of pants of suitable construction to include leather patches on each leg member and at least one, and preferably two, utility pockets of the character described. However, in work that requires frequent bending and kneeling it is desirable to have more material in the crotch and seat area than is normally provided in pants of standard design. Thus, a crotch gusset, as aforenoted, is preferably added to increase room and prevent stressing of the fabric in that area during bending and kneeling, thereby providing for enhanced user comfort and extended fabric wear. It can be appreciated that the added expanse of material supplied by a gusset can be incorporated into the design of panels for pants.

Although the present invention has been described in detail with reference to the illustrated embodiments, various modifications are contemplated to fall within the scope and spirit of the invention as defined in the appended claims.

What is claimed is:

1. A pair of work pants made of washable fabric and having a waistband end, a crotch area, and a pair of leg members depending to the ankle level of a user, each leg member having a front panel, a rear panel, an inseam, an outseam, a knee level area, and an ankle end, the work pants additionally including:

(a) a releasably attached leather patch over fabric of the front panel of each leg member, each said patch covering an area extending laterally from the outseam to the inseam of the leg member and extending lengthwise from a level above the knee level area but below the crotch area downwardly along the leg member to a level at least about two-thirds of the distance between the knee level area and the ankle end, the releasable attachment of each leather patch being formed by a slide fastener having separable halves, the first half being permanantly fixed to the patch along the entire patch perimeter and the second half being permanently fixed to the fabric of the leg member along the entire perimeter of the area of coverage of the patch so as to provide a mating slide fastener relationship to the first half fixed to the patch, each said leather patch being thereby conveniently removable from the fabric of the pants to avoid laundering damage to the leather at times of washing the fabric of the pants, and (b) a padding containment space between the leather patch and the underlying fabric of each leg member, each said containment space having removably held therewithin a padding material of layer form extending over an area substantially coextensive with the area of the patch, to thereby provide cushion protection of the knees of a user from jarring damage during drop kneeling activity regardless of whether or not the user raises the leg members of the pants for comfort purposes preliminarily to kneeling.

2. The pants of claim 1 additionally including: a removable leather utility pocket centered on the outseam of at least one leg member at a location therealong approximately midway between the waistband end and the knee level area of the leg member so that when the work pants are worn by a user the leather utility pocket is located on the user's mid outer thigh, the utility pocket being characterized by having an inner and an outer leather pocket panel with an upper pocket access opening therebetween and a bottom end formed by a line of juncture between said pocket panels, the pocket panels having forward and rearward substantially vertical side edges united together, the inner said pocket panel being of greater expanse than the outer said pocket panel and extending upwardly above the pocket access opening to form a pocket access protection area for protecting the fabric of the work pants above the utility pocket access opening from abrasive wear associated with utility pocket use, said utility pocket being removably attached to the fabric of the work pants by a slide fastener having separable halves, one half of the slide fastener being permanently fixed along the perimeter of the inner pocket panel other than along the bottom end line of juncture between said pocket panels, the other half of the slide fastener being permanently fixed to the underlying washable fabric of the pants along a line for a mating relationship with the half fixed to the inner pocket panel, whereby the slide fastener assumes an inverted U-shape permitting easy unfastening and removal of the leather utility pocket from the fabric of the pants at times of washing the fabric, said inverted U-shaped fastener being such as to leave the bottom end of the utility pocket unattached to the underlying fabric of the pants to thereby permit greater freedom of movement of the underlying fabric relative to the utility pocket during work activity.

3. The pants of claim 2 comprising a second removable utility pocket.

4. The pants of claim 2 wherein the inner and outer leather pocket panels are formed from a continuous layer of leather and the bottom end line of juncture between said pocket panels is formed by a fold of said continuous layer.

5. The pants of claim 1 wherein the slide fastener consists of a zipper.

6. The pants of claim 1 wherein the crotch area includes a fabric insert for providing increased room in the crotch area to improve comfort for a user during kneeling work activities.

7. The pants of claim 6 wherein the fabric insert comprises a crotch gusset.

8. The pants of claim 1 wherein the second half of each slide fastener is equipped with a cloth edge, and the cloth edge is sewn between the front and rear panels of each leg member along the inseam and outseam portions thereof.

9. A pair of work pants made of washable fabric and having a waistband end, a crotch area, and a pair of leg members depending to the ankle level of a user, each leg member having a front panel, a rear panel, an inseam, an outseam, a knee level area, and an ankle end, the work pants additionally including a removable utility pocket centered on the outseam of at least one leg member at a location therealong approximately midway between the waistband end and the knee level area of the leg member so that when the work pants are worn by a user the utility pocket is located on the user's mid outer thigh, the utility pocket being characterized by having an inner and an outer pocket panel with an upper pocket access opening therebetween and a bottom end formed by a line of juncture between said pocket panels, the pocket panels having forward and rearward substantially vertical side edges united together, the inner said pocket panel being of greater expanse than the outer said pocket panel and extending upwardly above the pocket access opening to form a pocket access protection area for protecting the fabric of the work pants above the utility pocket access opening from abrasive wear associated with utility pocket use, said utility pocket being removably attached to the fabric of the work pants by a slide fastener having separable halves, one half of the slide fastener being permanently fixed along the perimeter of the inner pocket panel other than along the bottom end line of juncture between said pocket panels, the other half of the slide fastener being permanently fixed to the underlying washable fabric of the pants along a line for a mating relationship with the half fixed to the inner pocket panel, whereby the slide fastener assumes an inverted U-shape permitting easy unfastening and removal of the utility pocket from the fabric of the pants at times of washing the fabric, said inverted U-shaped fastener being such as to leave the bottom end of the utility pocket unattached to the underlying fabric of the pants to thereby permit greater freedom of movement of the underlying fabric relative to the utility pocket during work activity.

* * * * *